US006402669B1

(12) United States Patent
Olstad

(10) Patent No.: US 6,402,669 B1
(45) Date of Patent: Jun. 11, 2002

(54) LEG EXERCISE APPARATUS

(76) Inventor: Carol A. Olstad, 9004 Murphy Rd., Cotton, MN (US) 55724

( * ) Notice: Subject to any disclaimer, the term of this patent is extended or adjusted under 35 U.S.C. 154(b) by 0 days.

(21) Appl. No.: 09/754,195

(22) Filed: Jan. 5, 2001

(51) Int. Cl.[7] ..... A63B 21/02
(52) U.S. Cl. ..... 482/123; 482/148
(58) Field of Search ..... 482/121–130, 482/148; 272/146, 96, 72; 601/34, 35, 27, 28, 33

(56) References Cited

U.S. PATENT DOCUMENTS

| | | | | | |
|---|---|---|---|---|---|
| 3,428,312 | A | * | 2/1969 | Machen | 272/80 |
| 3,749,400 | A | * | 7/1973 | Stoffel | 272/83 R |
| 4,251,070 | A | | 2/1981 | Leseberg | |
| 4,277,062 | A | * | 7/1981 | Lawrence | 482/131 |
| 4,522,392 | A | | 6/1985 | Torii | |
| 4,603,857 | A | * | 8/1986 | Chipman et al. | 482/123 |
| 4,979,737 | A | | 12/1990 | Kock | |
| 5,154,684 | A | * | 10/1992 | Delf | 482/116 |
| 5,489,251 | A | | 2/1996 | Robles, Jr. | |
| 5,669,863 | A | | 9/1997 | Ho | |
| 5,690,594 | A | | 11/1997 | Mankovitz | |
| 5,725,462 | A | | 3/1998 | Jones | |
| 5,961,429 | A | * | 10/1999 | Hsu | 482/142 |
| 6,213,924 | B1 | * | 4/2001 | Kaiyoorawongs | 482/146 |

FOREIGN PATENT DOCUMENTS

| | | |
|---|---|---|
| CA | 1059174 | 7/1979 |
| CA | 1206495 | 6/1986 |
| CA | 1211766 | 9/1986 |

* cited by examiner

*Primary Examiner*—Jerome W. Donnelly
*Assistant Examiner*—Lori Baker Amerson
(74) *Attorney, Agent, or Firm*—Richard C. Litman

(57) ABSTRACT

A leg exercising apparatus for persons requiring less strenuous exercise in a supine position, comprising two rotatable posts involving springs and having heel cups positionable at different heights, the posts being integrated with a base and mat. Another embodiment provides two doubled posts with greater durability and adjustability in strength resistance, but limited in leg movement.

8 Claims, 4 Drawing Sheets

LEG EXERCISE APPARATUS

BACKGROUND OF THE INVENTION

1. Field of the Invention

The present invention relates generally to an exercise apparatus and, more specifically, to a leg exercising apparatus comprising a mat integrated with two rotatable posts having adjustable height heel cups. One embodiment employs doubled posts with limited sideways movement.

2. Description of the Related Art

The related art of interest describes various leg exercising apparatus, but none discloses the present invention. There is a distinct need for a portable exercise apparatus which combines synergistically the effect of elevating one's legs while moving them with some adjustable resistance. The portable apparatus is a device for exercising the legs to improve the muscle tone of the legs in the comfort of the home.

The related art will be discussed in the order of perceived relevance to the present invention.

U.S. Pat. No. 5,669,863, issued on Sep. 23, 1997 to Sung-Chao Ho, describes a leg exercising apparatus adapted for use at home comprising a retractable support bar having a suction disk at a bottom end and a horizontal handle bar at a top end, and a linking-up bar having a T-shaped foot rest at one end which is connected to the support bar by either a resilient bar or spring. The apparatus is distinguishable for its structure which requires a sitting position and the use of hands.

U.S. Pat. No. 4,277,062, issued on Jul. 7, 1981 to Mark Lawrence, describes a leg stretching device comprising a platform seat having an upwardly extending backrest and a pair of handles extending outwardly from the platform. A telescoping bar at the intersection of the backrest and platform seat provides a rope on pulleys at each end of the bar. A stirrup for one's foot and a handle are provided at each end of the rope for stretching one or both legs. The device is distinguishable for its seating structure with individual handles for stretching the legs positioned in stirrups against the force of the held handles.

U.S. Pat. No. 4,522,392, issued on Jun. 11, 1985 to Masakatsu Torii, describes a spring type leg exercising device comprising a pair of spring biased, slidable base frames on opposite sides of a central member. The user stands on the base frames and spreads his legs away from each other in opposite directions and then returns the legs towards each other.

U.S. Pat. No. 3,749,400, issued on Jul. 31, 1973 to Charles R. Stoffel, describes a spring type leg exercise device comprising an elongated base having a pair of guide tracks with a spring loaded foot support. The device is distinguishable for its dissimilar structure requiring an open box shape and a pushable foot support.

U.S. Pat. No. 4,251,070, issued on Feb. 17, 1981 to Helen M. Leseberg, describes a supine exercise device comprising a pair of moccasin-type stirrups attached to hand grip bars. The device is distinguishable for requiring handles attached to canvas or heat cloth stirrups.

U.S. Pat. No. 4,979,737, issued on Dec. 25, 1990 to Ronald W. Kock, describes an apparatus for exercising lower leg muscles of one leg comprising a housing block on a base plate maintained stable by a handle held by the patient on a training table. The right foot is strapped to a planar footplate having heel blocks on a rotatable shaft attached to one side of the housing block. Variable resistance is supplied on the opposite side of the housing by a fixed friction disk coacting with the rotating friction disk on the shaft compressed by an adjustable handwheel and spring. The apparatus is distinguishable for its one leg operation and requirement for friction disks and a stabilizing handle.

U.S. Pat. No. 5,489,251, issued on Feb. 6, 1996 to Sherman U. Robles, Jr., describes an exercise device comprising a foot harness connected by a rod to a tension adjusting mechanism housed on a thigh harness. The tension adjusting mechanism contains a slidable spring plate attached on one side to a spring and the rod of the foot harness. A threaded adjustment rod of the positioning mechanism with an external handle is attached to the opposite side of the slidable spring plate. The exercise device is distinguishable for its thigh harness and tension adjusting mechanism connected to a foot harness.

U.S. Pat. No. 5,690,594, issued on Nov. 25, 1997 to Roy J. Mankovitz, describes an exercise apparatus for use with office chairs comprising a foot bar with end wheels connected to the legs of a non-swivel chair or to the support post of a swivel chair by a plurality of rubber straps. The apparatus is distinguishable for its requirement of a wheeled foot bar and rubber straps.

U.S. Pat. No. 5,725,462, issued on Mar. 10, 1998 to Tom Jones, describes a reciprocal inhibition exercise device comprising a frame structure including a leg beam, a bottom cross member, a back support member, a front support member, a front vertical support member, and an exercise grip bar. The leg beam has a pair of foot pad slides attached to a spring and a leg beam middle plate. The foot pad slides have rotatable stirrups attached to a foot pad pedestal. Front and back grip bars are also provided. The device is distinguishable for its frame structure requiring multitudinous parts.

Canadian Pat. No. 1,059,174, issued on Jul. 7, 1979, describes an elastic exerciser device having three triangular handles in a Y-shape. The stretchable exerciser device for the arms by using only the hands or in concert with the feet. The device is distinguishable for its singular Y-shaped structure.

Canadian Pat. No. 1,206,495, issued on Jun. 24, 1986, describes an exercise device comprising a frame freely supporting a person by the arms and providing spring resistance for straightening the legs against the frame. The device is distinguishable for its frame structure.

Canadian Pat. No. 1,211,766, issued on Sep. 23, 1986, describes an adjustable bench mounted leg lift exerciser device comprising a bench with a seat and an L-shaped member having two arms pivotable for holding the ankles and attaching weights. The device is distinguishable for its requirement for a bench and pivoting L-shaped arms.

Canadian Pat. No. 2,045,690, issued on Aug. 4, 1990, describes a leg exerciser apparatus comprising a frame with two four-bar linkages arranged side by side. Each linkage carries a foot pad and is attached to a double acting hydraulic cylinder connected to a variable flow control valve to vary the resistance to linkage movement. The apparatus is distinguishable for its four-bar linkages requiring hydraulic cylinders for resistance.

None of the above inventions and patents, taken either singularly or in combination, is seen to describe the instant invention as claimed. Thus, a portable leg exercising device solving the aforementioned problems is desired.

SUMMARY OF THE INVENTION

The present invention is directed to an integrated mat and leg exercising apparatus comprising a pair of padded rotatable posts having heel cups which are adjustable in height. Rubber springs, which may be inside or outside the posts, enable the rotation. The user lies supine on the mat, moving the legs alternatively or together to achieve the synergistic benefit of elevating one's legs and exercising them simultaneously or individually. A third embodiment utilizes a pair of doubled posts connected by a pair of crossed rubber cables covered by either padding or rubber tubing.

Accordingly, it is a principal object of the invention to provide a leg exercising apparatus for improving the muscle tone of the legs while keeping the legs elevated for improved circulation.

It is another object of the invention to provide a leg exercising apparatus integrated with a mat and having rubber coils proximate the base of each post for providing resistance to rotation of the posts.

It is a further object of the invention to provide a leg exercising apparatus with heel cups made of mesh material on each post, the heel cups being adjustable in height to alter the position of the legs for the comfort of the user.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a leg exercising apparatus for improving muscle tone in the legs while improving circulation by keeping the legs elevated during exercise. The device is used by a person lying supine on a comfortable mat which has the exercising portion attached to prevent slippage, and features flexible heel cups positioned at an adjustable height on the posts which swivel in various directions with minimal resistance.

Figure 1:
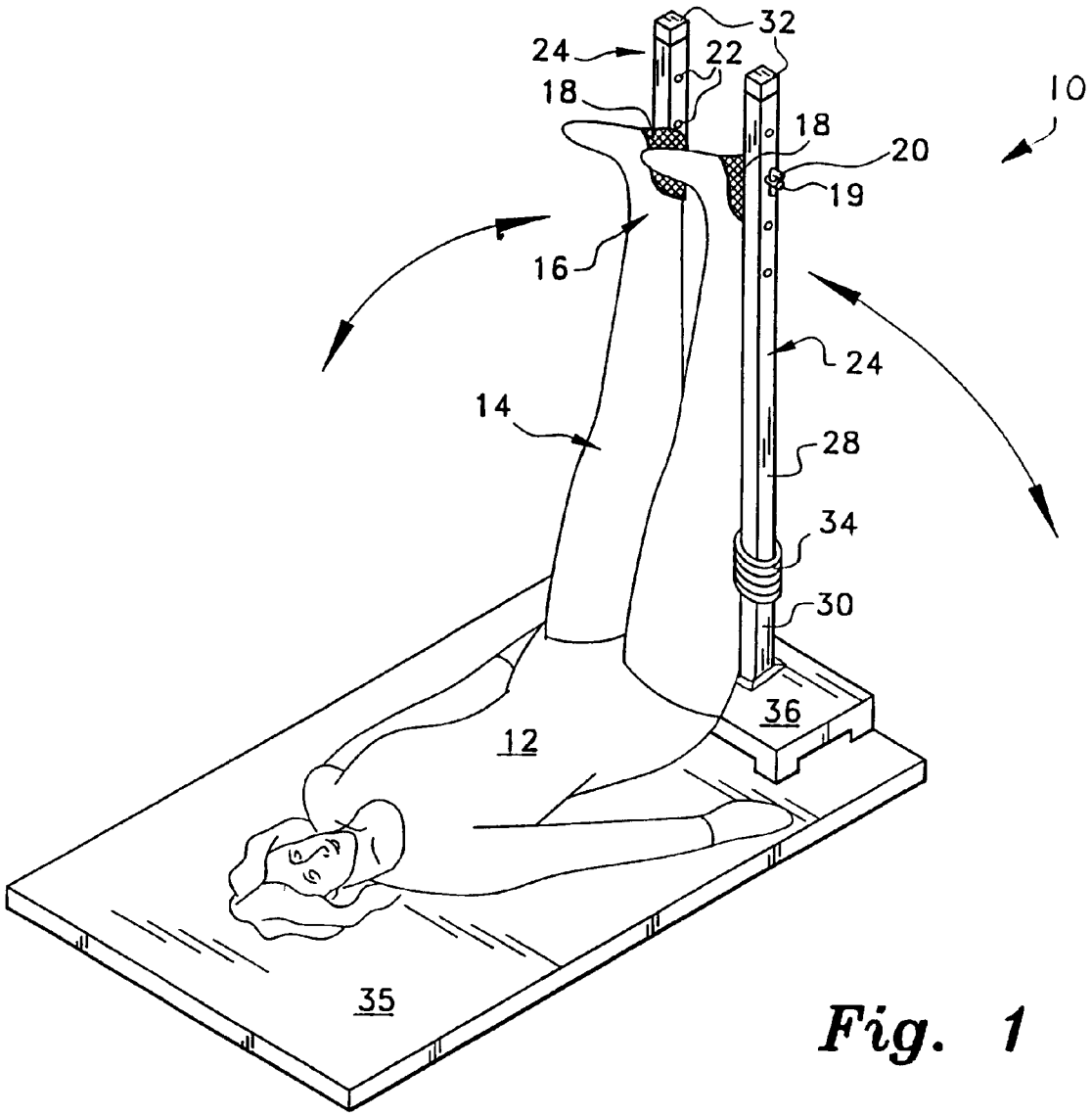
FIG. 1 is an environmental, perspective view of a first embodiment of a leg exercising apparatus utilizing heel cups according to the present invention.
Figure 2:
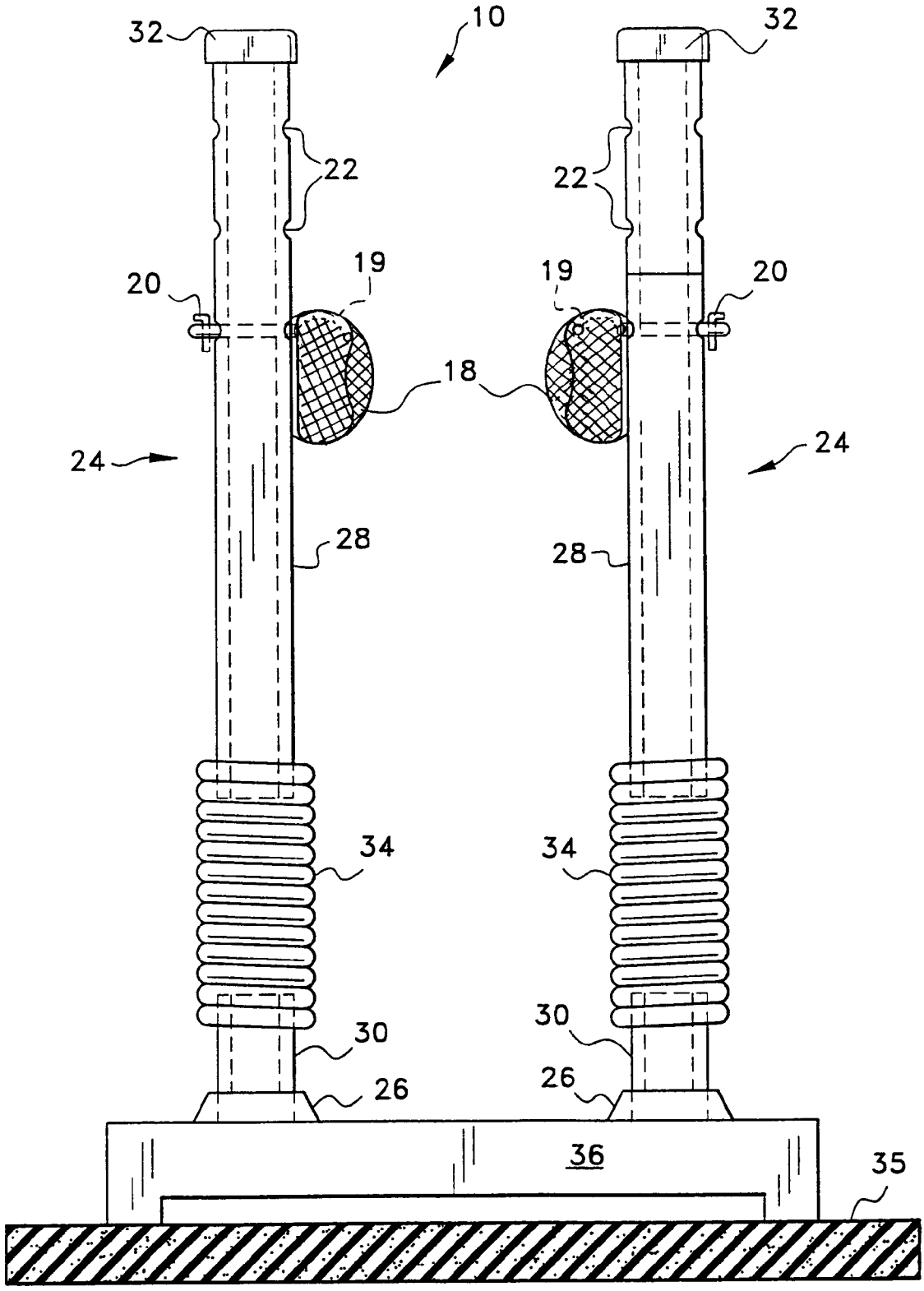
FIG. 2 is an enlarged elevational view of the first embodiment of the present invention with an exercise apparatus with posts having overlapping rubber coils affixed on a stand and mat.

In the first embodiment of the portable exercise apparatus 10 illustrated in FIGS. 1 and 2, a person 12 (FIG. 1) is lying in a supine position with her legs 14 extended upward with her heels 16 held by flexible heel cups 18 made of a mesh material supported on U-shaped hooks 19 at the end of bars retained by pins 20 in one of the plurality of apertures 22 in the padded posts 24 supported by cup-shaped base brackets 26. Each post 24 is separated into two sections with an upper section or portion 28 having a cap 32 and a lower section or portion 30. Each section or portion 28 and 30 is connected externally by a compact rubber or rubber coated metal spring 34 and to a stand 36 which is preferably attached further by fasteners (not shown) to the rectangular mat 35. The mat 35 can be made of durable flexible material such as carpeting.

As the arrows indicate in FIG. 1, the legs 14 can be moved in any direction from forward to backwards, sideways and rotated together or separately. In FIG. 2, the hooks 19 can be placed in any of the exemplary three apertures 22 (attachment to the bottom aperture shown) in the upper section or portion 28 of the padded posts 24 to position the heel cups 18 on the inside of the posts. The different positions of the heel cups 18 permit the user to bend his or her knees to a comfortable position while exercising. Although the padded posts 24 are shown having a square crosssection, the posts in this embodiment can be cylindrical to conform to the external shape of the springs 34.

Figure 3:
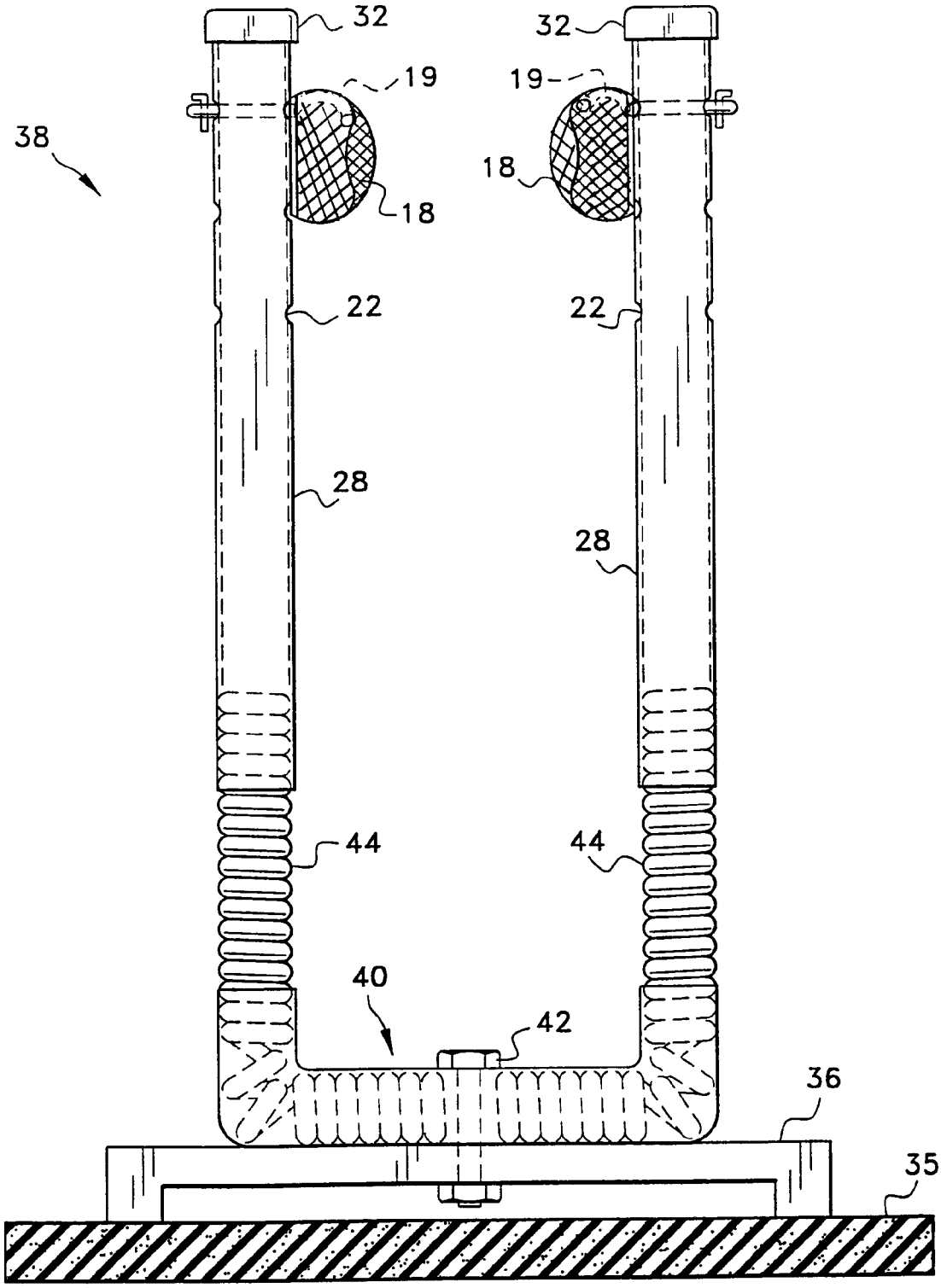
FIG. 3 is an elevational view of a second embodiment of the present invention with the exercise apparatus having rubber coils encased in the connected posts affixed on a stand and mat.

A second embodiment 38 of a portable leg exercise apparatus is depicted in FIG. 3 having a U-shaped bottom piece 40 on the stand 36 secured by a fastener 42. The upper ends of the pair of springs 44 are partially encased in the upper sections or portions 28, and a portion is exposed between the upper sections 28 and the bottom piece 40. The heel cups 18 are now placed in the uppermost aperture 22 and held by hooks 19 and pins 20. The movement of the upper sections or portions 28 of the exercise apparatus 38 can be in any direction as mentioned above.

Figure 4:
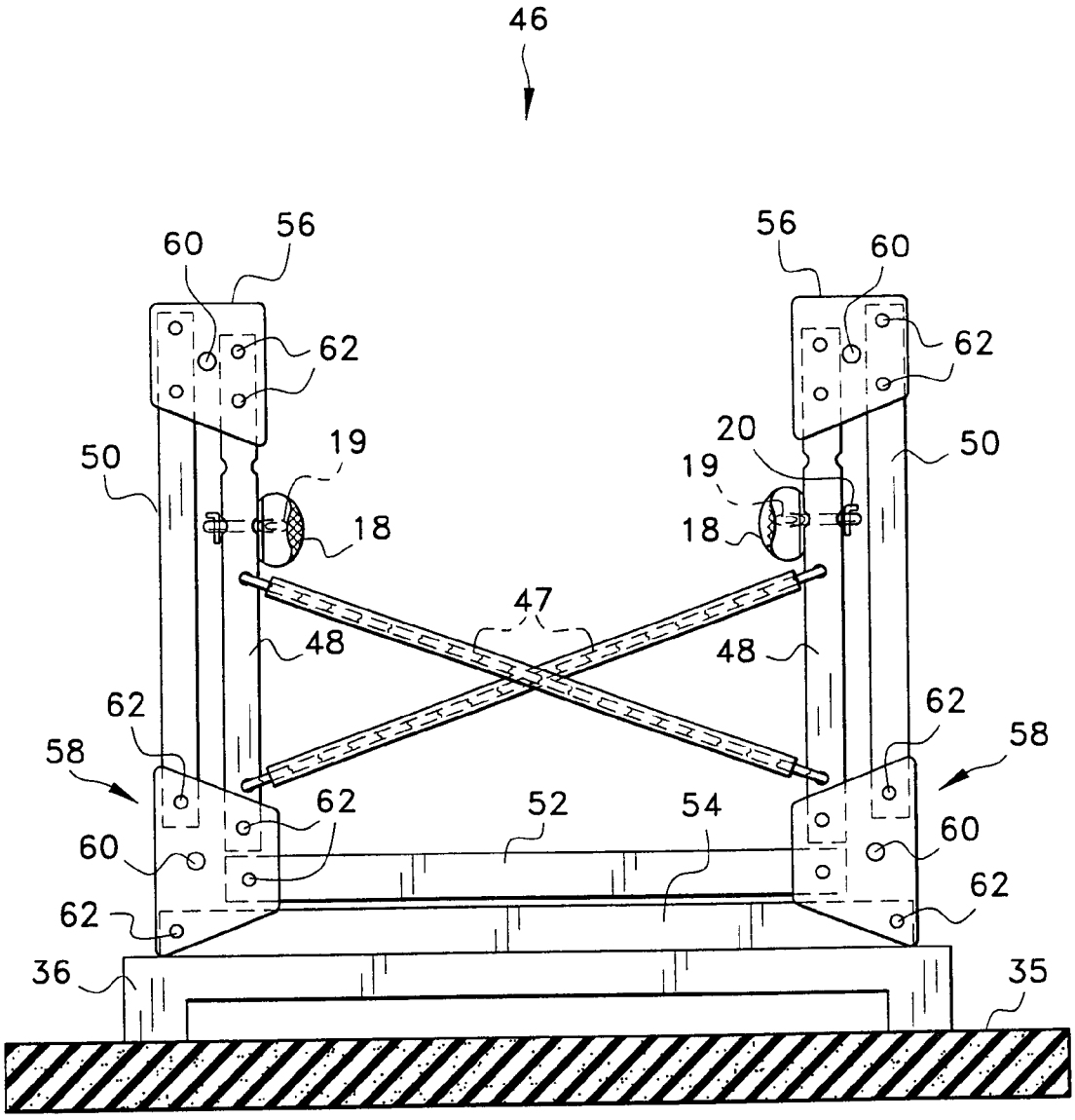
FIG. 4 is third embodiment of the present invention wherein the exercising apparatus has doubled posts with two pairs of external springs.

FIG. 4 is drawn to a third embodiment of a portable leg exercising apparatus 46 having doubled posts with inner posts 48 and outer posts 50 (all posts and crossbars having a square cross-section) connected by a pair of elastic elements 47, such a rubber bungee cords or bands, although coil springs may also be used, which are covered by either padding or a rubber tube and secured by pins 62, and an upper crossbar 52. The apparatus 46 further comprises a lower crossbar 54, an upper pair of brackets 56, and a lower pair of brackets 58 secured on a stand 36 and mat 35. Each bracket 56, 58 can be in two parts or one-piece secured at the ends of the posts 48, 50 and crossbars 52, 54 by a centered pin 60. Other pins 62 secure the ends of the posts 48, 50 and crossbars 52, 54 in the respective brackets 56, 58.

Each heel cup 18 is placed on hooks 19 on the inside of the inner padded posts 48. The inner and outer posts 48, 50 on either side of the apparatus 46 are restricted in movement only in a sideways direction due to the brackets 56, 58. This exercise apparatus 46 may be limited in movement, but provides a more durable apparatus with adjustability in the strength of movement due to the elastic elements 47 which are not bent, and also can be exchanged for adjustability in stretching capacity.

Thus, at least three embodiments of a leg exercising apparatus for persons who desire home-based apparatus having the capacity to readily adjust the resistance and the height of their feet while in a supine position have been shown.

It is to be understood that the present invention is not limited to the embodiments described above, but encompasses any and all embodiments within the scope of the following claims.

I claim:

1. A leg exercising apparatus comprising:

a pair of upright hollow posts, each having an upper portion and a lower portion, each said upper portion configured with a padded surface and a series of apertures;

a coiled spring connecting the upper and lower portions of each hollow post, wherein the springs are positioned inside the upper and lower portions of each hollow post, and with a portion of each spring exposed to permit rotation of each post;

a pair of hooks, each hook being removably inserted through one of the series of apertures in each said post for adjustment in height;

a flexible heel cup depending from each hook, the heel cup being adapted for receiving a person's ankle;

a base configured supporting the pair of upright posts; and a rectangular mat attached to the base;

wherein a person's heels are placed in the heel cups and the person's legs rotated while one is supine on the mat, the person's leg muscles being toned up by bending the posts against the resistance of the springs.

2. The leg exercising apparatus according to claim 1, wherein the lower portions of each post are configured as a U-shaped continuous piece and fastened to the base.

3. The leg exercising apparatus according to claim 1, further including a cap attached to each post's upper portion, respectively.

4. A leg exercising apparatus comprising:

a pair of doubled posts each having an upper end and a lower end, each doubled post defined by an inner post parallel to an outer post, each inner post having with a series of apertures;

a hooked fastener removably inserted through an aperture of each inner post and facing inwards;

a flexible heel cup depending from each hooked fastener;

a pair of flexible elastic elements attached in criss-cross fashion to each inner post;

an upper crossbar adjacent the lower end of each inner post;

a pair of upper brackets pivotally attached to each upper end of each doubled post, and a pair of lower brackets attached to each lower end of each inner post and to said upper crossbar;

a lower crossbar parallel to the upper crossbar and pivotally attached to each lower bracket adjacent the lower end of each outer post;

a base attached to the lower crossbar; and a rectangular mat attached to the base;

wherein a person's heels are placed in the heel cups and the person's legs moved from side to side while one is supine on the mat, the person's leg muscles being toned by moving against the resistance of said elastic elements.

5. The leg exercising apparatus according to claim 4, wherein each post, upper crossbar and lower crossbar have a square cross-section.

6. The leg exercising apparatus according to claim 4, wherein the inside posts are padded and the elastic elements are covered by a rubber tubing or padding.

7. The leg exercising apparatus according to claim 4, wherein each elastic element has its upper and lower ends attached to an inner post.

8. The leg exercising apparatus according to claim 4, wherein each bracket has a centered pin to permit the movement of the inside and outside posts.

* * * * *